US009859638B2

(12) United States Patent
Fu et al.

(10) Patent No.: US 9,859,638 B2
(45) Date of Patent: Jan. 2, 2018

(54) CONNECTOR

(71) Applicant: Tyco Electronics (Shanghai) Co. Ltd., Shanghai (CN)

(72) Inventors: Xiaozhi Fu, Shanghai (CN); Ming Shi, Shanghai (CN); Xiang Xu, Shanghai (CN); Wei Zhang, Shanghai (CN)

(73) Assignee: Tyco Electronics (Shanghai) Co., Ltd., Shanghai (CN)

( * ) Notice: Subject to any disclaimer, the term of this patent is extended or adjusted under 35 U.S.C. 154(b) by 0 days.

(21) Appl. No.: 15/245,311

(22) Filed: Aug. 24, 2016

(65) Prior Publication Data

US 2017/0062961 A1 Mar. 2, 2017

(30) Foreign Application Priority Data

Aug. 27, 2015 (CN) ..... 2015 2 0655820 U

(51) Int. Cl.

| | |
|---|---|
| ***H01R 12/75*** | (2011.01) |
| ***H01R 13/50*** | (2006.01) |
| ***H01R 12/71*** | (2011.01) |
| ***H01R 4/48*** | (2006.01) |
| ***H01R 12/51*** | (2011.01) |
| *H01R 12/57* | (2011.01) |

(52) U.S. Cl.

CPC ..... *H01R 12/75* (2013.01); *H01R 4/4827* (2013.01); *H01R 12/515* (2013.01); *H01R 12/716* (2013.01); *H01R 13/50* (2013.01); *H01R 12/57* (2013.01)

(58) Field of Classification Search

CPC .... H01R 12/75; H01R 12/515; H01R 12/716; H01R 12/57; H01R 4/4827; H01R 13/50

See application file for complete search history.

(56) References Cited

U.S. PATENT DOCUMENTS

| | | | | |
|---|---|---|---|---|
| 5,197,891 | A * | 3/1993 | Tanigawa | H01R 12/716 439/83 |
| 5,711,680 | A * | 1/1998 | Tsuneaki | H01R 4/028 439/83 |
| 6,287,130 | B1 * | 9/2001 | Torii | H01R 12/707 439/83 |
| 7,556,515 | B2 * | 7/2009 | Kato | H01R 13/193 439/171 |
| 7,704,082 | B2 * | 4/2010 | Daily | H01R 12/57 439/83 |
| 7,789,677 | B2 * | 9/2010 | Yang | H01R 12/7052 439/564 |
| 7,850,466 | B2 * | 12/2010 | Mostoller | H01R 12/57 439/83 |

(Continued)

*Primary Examiner* — Briggitte R Hammond

(74) *Attorney, Agent, or Firm* — Barley Snyder

(57) ABSTRACT

A connector is disclosed. The connector comprises a housing and at least one conductive terminal received in the housing. The housing has a flange mounted on a first surface of a circuit board and a body extending through the circuit board beyond an opposite second surface of the circuit board. The body has an insertion hole. The at least one conductive terminal has a pair of resilient contact arms contacting a wire inserted through the insertion hole, a pair of solder feet soldered to the circuit board and electrically connected to the pair of resilient contact arms, and a releasing mechanism adapted to move the pair of resilient contact arms away from each other to release the wire.

24 Claims, 6 Drawing Sheets

(56) References Cited

U.S. PATENT DOCUMENTS

| | | | | |
|---|---|---|---|---|
| 8,100,703 | B2 * | 1/2012 | Chen | H01R 12/716 439/83 |
| 8,550,838 | B2 * | 10/2013 | Osagle | H01R 4/4818 439/441 |
| 8,882,533 | B2 * | 11/2014 | Brandberg | H01R 13/193 439/441 |
| 9,136,641 | B2 * | 9/2015 | Bishop | H01R 4/4836 |
| 2003/0186571 | A1 * | 10/2003 | Lin | H01R 12/57 439/83 |
| 2013/0210247 | A1 * | 8/2013 | Wang | H01R 12/57 439/83 |
| 2014/0024269 | A1 * | 1/2014 | Decker | H01R 4/4818 439/733.1 |

* cited by examiner

CONNECTOR

CROSS-REFERENCE TO RELATED APPLICATION

This application claims the benefit of the filing date under 35 U.S.C. §119(a)-(d) of Chinese Patent Application No. 201520655820.4, filed on Aug. 27, 2015.

FIELD OF THE INVENTION

The present invention relates to a connector, and more particularly, to a connector allowing a wire to be plugged and pulled out repeatedly.

BACKGROUND

In the prior art, a connector for connecting a wire is commonly mounted on one surface of a circuit board, forming a connector assembly. The connector extends at a height from the surface of the circuit board, and the connector assembly thus occupies a significant space defined by the height of the connector. Furthermore, in many known connectors, once a wire is inserted into the connector it cannot be removed intact and cannot be replaced.

SUMMARY

An object of the invention, among others, is to provide a connector for a connector assembly having a reduced overall height, reducing the space occupied by the connector assembly. The disclosed connector comprises a housing and at least one conductive terminal received in the housing. The housing has a flange mounted on a first surface of a circuit board and a body extending through the circuit board beyond an opposite second surface of the circuit board. The body has an insertion hole. The at least one conductive terminal has a pair of resilient contact arms contacting a wire inserted through the insertion hole, a pair of solder feet soldered to the circuit board and electrically connected to the pair of resilient contact arms, and a releasing mechanism adapted to move the pair of resilient contact arms away from each other to release the wire.

BRIEF DESCRIPTION OF THE DRAWINGS

The invention will now be described by way of example with reference to the accompanying figures, of which.

DETAILED DESCRIPTION OF THE EMBODIMENT(S)

The invention is explained in greater detail below with reference to embodiments of a connector. This invention may, however, be embodied in many different forms and should not be construed as limited to the embodiments set forth herein; rather, these embodiments are provided so that this disclosure will be thorough and complete and still fully convey the scope of the invention to those skilled in the art.

A connector 300 according to the invention is shown generally in FIGS. 1-4. The connector 300 has a housing 1 and at least one conductive terminal 2.

The major components of the invention will now be described in greater detail.

Figure 2:
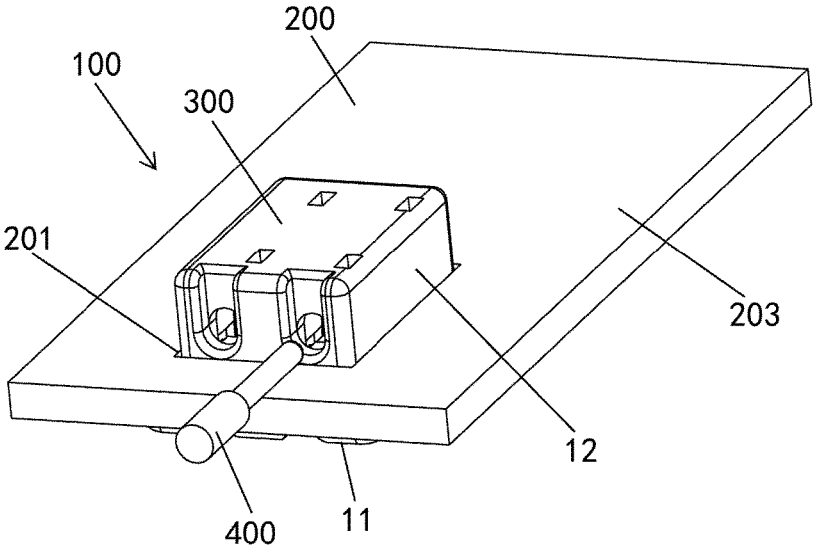
FIG. 2 is bottom perspective view of the connector of FIG. 1 mounted on the circuit board.
Figure 3:
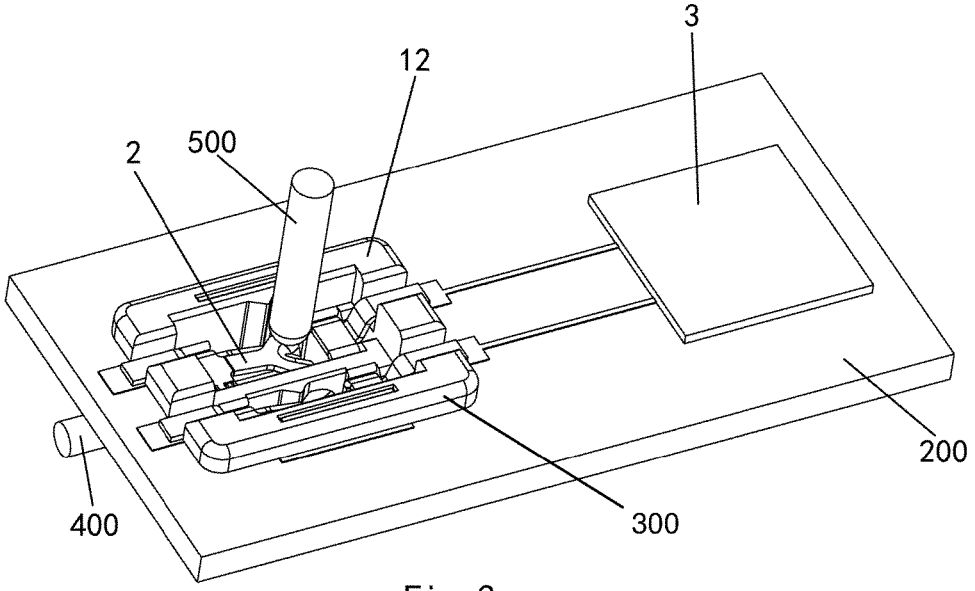
FIG. 3 is a perspective view of the connector of FIG. 1 mounted on the circuit board with a wire and an external releasing tool.
Figure 4:
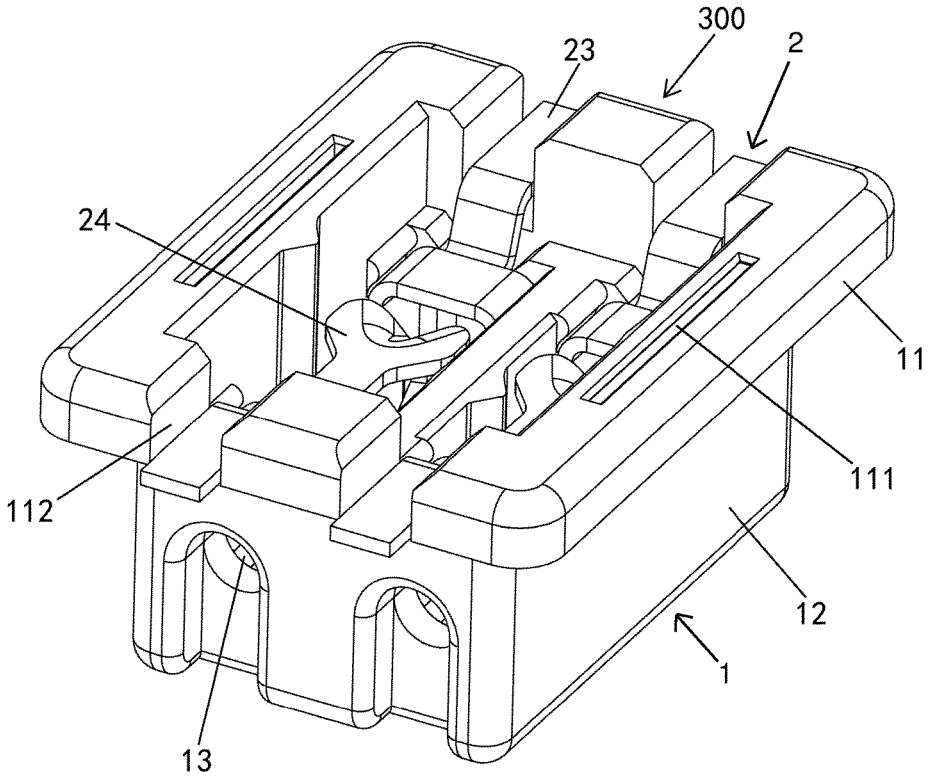
FIG. 4 is a perspective view of the connector of FIG. 1.

The housing 1 is shown in FIGS. 1-4. In the shown embodiment, the housing 1 is made of an insulative material, such as a plastic, and is formed by molding. As shown in FIG. 4, the housing 1 has a body 12 and a flange 11 formed at an end of the body 12. The body 12 and the flange 11 are integrally connected. The body 12 has insertion holes 13 extending through a side of the body 12. The flange 11 projects outward from an opening of the body 12. The flange 11 has a plurality of mounting holes 111 extending through a top surface of the flange 11 and a plurality of slots 112 extending through sides of the flange 11.

Figure 5:
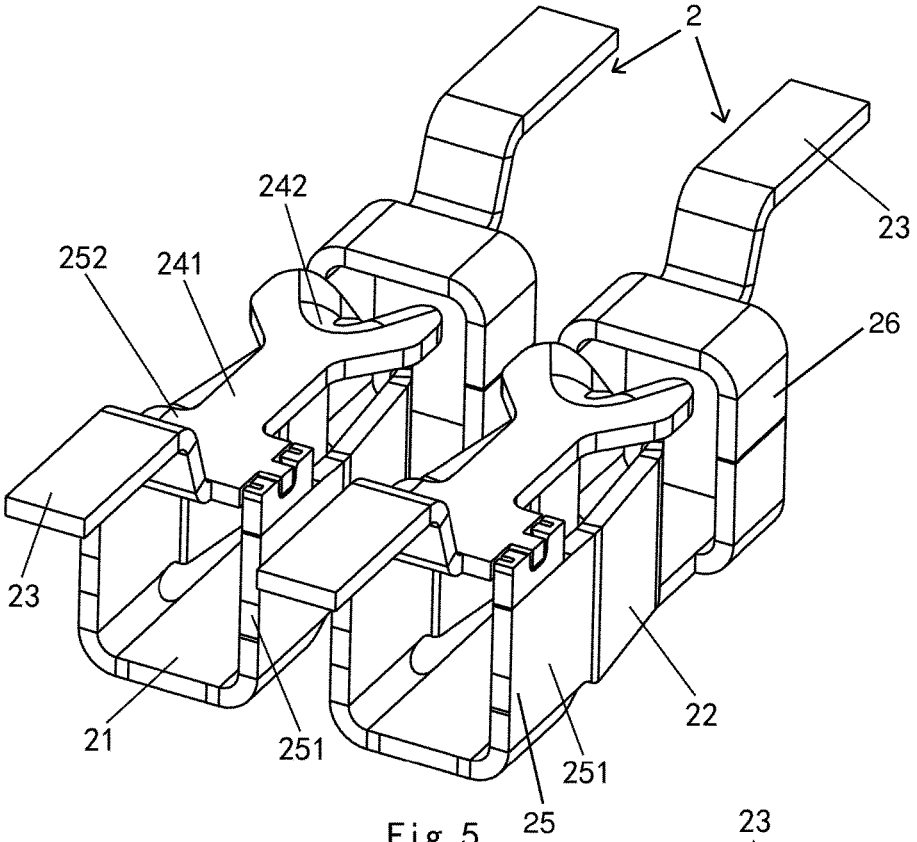
FIG. 5 is a perspective view of a conductive terminal of the connector of FIG. 1.
Figure 6:
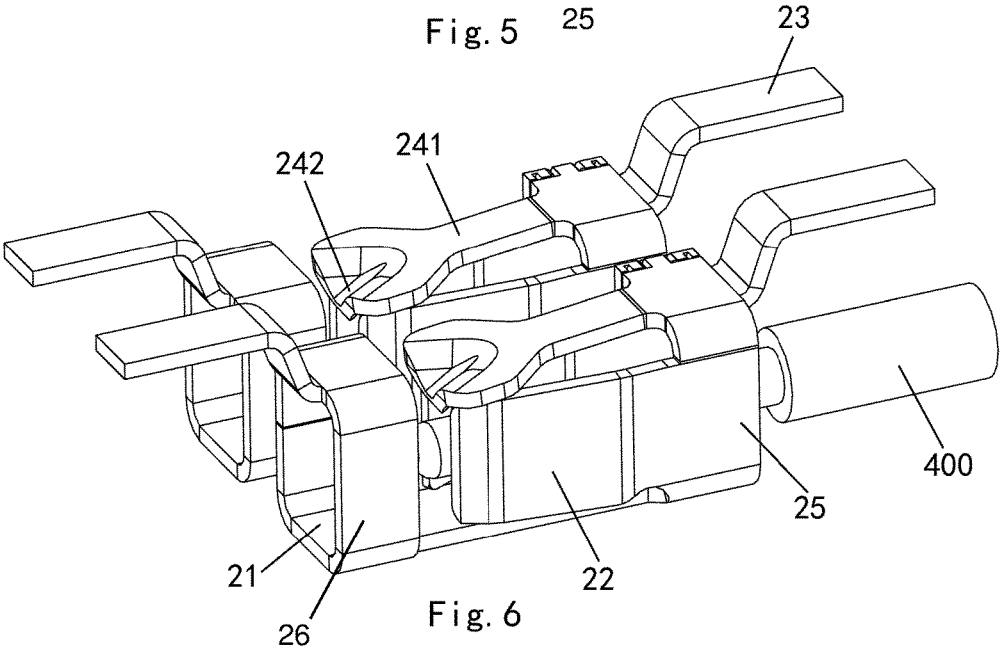
FIG. 6 is a perspective view of the conductive terminal of FIG. 5 with the wire.
Figure 7:
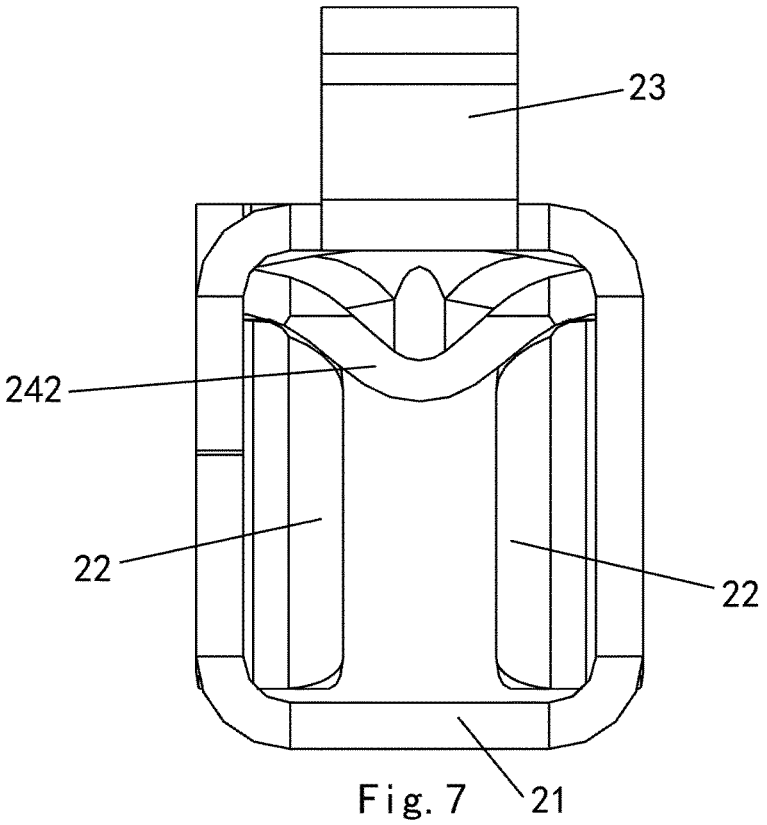
FIG. 7 is a front view of the conductive terminal of FIG. 5.

The at least one conductive terminal 2 is shown in FIGS. 2-8. As shown in FIGS. 5 and 6, each conductive terminal 2 has a base 21, a first annular end portion 25 located at a first end of the base 21 and a second annular end portion 26 located at an opposite second end of the base 21. The first annular end portion 25 has two side walls 251 and a top 252. Each conductive terminal 2 also has a pair of resilient contact arms 22, a releasing mechanism 24, and a pair of solder feet 23.

The pair of resilient contact arms 22 are cantilevered and have a fixed end and a free end. The fixed end of each of the resilient contact arms 22 is attached to a side wall 251 of the first annular end portion 25. The free ends of the pair of resilient contact arms 22 extend from the first annular end portion 25 toward the second end of the base 21 and center of the conductive terminal 2 such that they are biased toward each other.

The releasing mechanism 24 includes a cantilever 241 and a wedged protrusion 242. A first end of the cantilever 241 is attached to the top 252, and the cantilever 241 extends to an opposite second end in a direction toward the second end of the base 21. The wedged protrusion 242 is disposed at the second end of the cantilever 241. The wedged protrusion 242 is adapted to be inserted between the pair of resilient contact arms 22 to move the pair of resilient contact arms 22 in a direction away from each other.

One of the pair of solder feet 23 extends from the top 252 of the first annular end portion 25 in a direction away from the conductive terminal 2, and the other of the pair of solder feet 23 extends from a top of the second annular end portion 26 in a direction away from the conductive terminal 2. The pair of solder feet 23 are electrically connected to the pair of resilient contact arms 22.

The housing 1 receives the at least one conductive terminal 2 such that the at least one conductive terminal 2 is disposed in an interior of the body 12, forming the connector 300 as shown in FIG. 4. The pair of solder feet 23 on each of the at least one conductive terminal 2 extend through the plurality of slots 112 to an exterior of the housing 1. Each insertion hole 13 aligns with one first annular end portion 25.

The attachment of the connector 300 to a circuit board 200 and a wire 400 will now be described in greater detail with reference to FIGS. 1-3 and 6-8.

Figure 1:
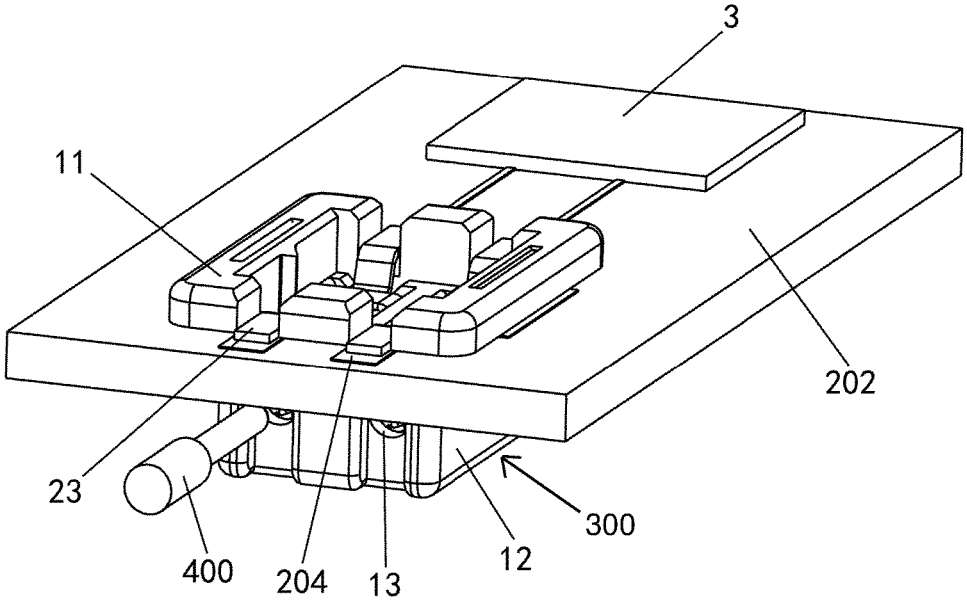
FIG. 1 is a top perspective view of a connector according to the invention mounted on a circuit board.

The circuit board 200, as shown in FIGS. 1-3, has an opening 201 extending through a thickness of the circuit board 200, a first surface 202, an opposite second surface 203, and pads 204 disposed on the first surface 202.

The connector 300 is inserted in the opening 201 such that the body 12 is disposed below the second surface 203 and the flange 11 is retained on the first surface 202. The housing 1 is mounted on the circuit board 200 by fasteners (not shown) extending through the plurality of mounting holes 111. The pair of solder feet 23 are soldered to corresponding pads 204 by means of surface-mount technology (SMT). The connector 300 mounted on the circuit board 200 forms the connector assembly 100 shown in FIG. 2.

Figure 8:
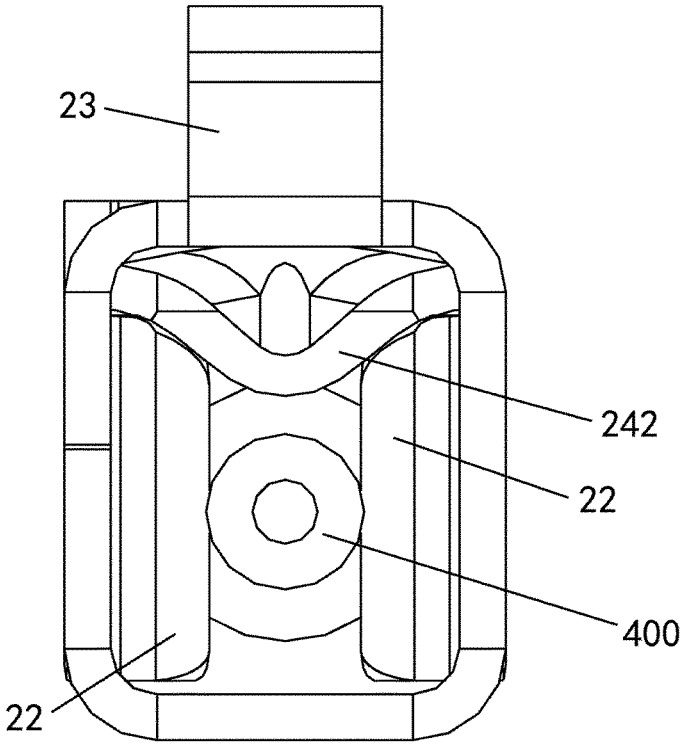
FIG. 8 is a front view of the conductive terminal of FIG. 5 with the wire.

The wire 400, as shown in FIGS. 1-3, 6, and 8, is inserted through the insertion hole 13, into the first annular end portion 25, and is disposed between the pair of resilient contact arms 22. The wire 400 is held in the conductive terminal 2, as shown in FIGS. 6 and 8, by the resilient force of the resilient contact arms 22, ensuring a reliable electrical connection between the wire 400 and the conductive terminal 2. An end of the wire 400 is disposed in the second annular end portion 26.

As shown in FIGS. 1 and 3, a lid 3 corresponds to the flange 11 and may be detachably mounted on the flange 11 to cover an interior of the housing 1.

An external releasing tool 500, as shown in FIG. 3, is adapted to press the wedged protrusion 242 from above the circuit board 200, so as to separate the pair of resilient contact arms 22 in a direction away from each other, allowing the wire 400 gripped between the pair of resilient contact arms 22 to be pulled out from the conductive terminal 2. In the shown embodiment, the external releasing tool 500 is a cylindrical member and may be a screwdriver. In an embodiment in which the lid 3 is mounted on the flange 11, the lid 3 is provided with at least one first releasing hole (not shown) aligned with the wedged protrusion 242, and the external releasing tool 500 is adapted to be inserted in the first releasing hole from above the circuit board 200 to press the wedged protrusion 242.

Figure 9:
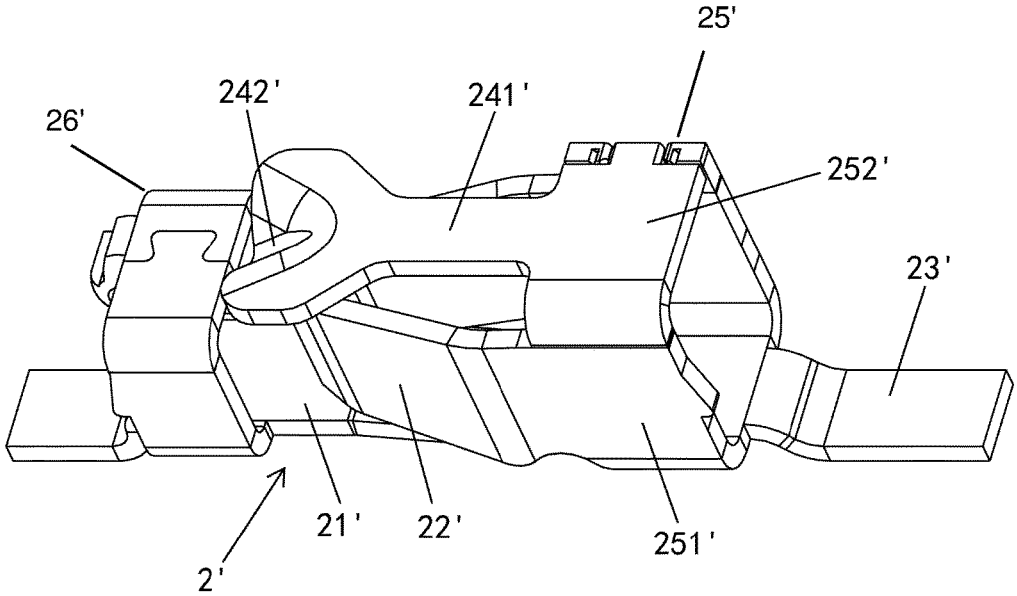
FIG. 9 is a perspective view of another conductive terminal according to the invention.
Figure 10:
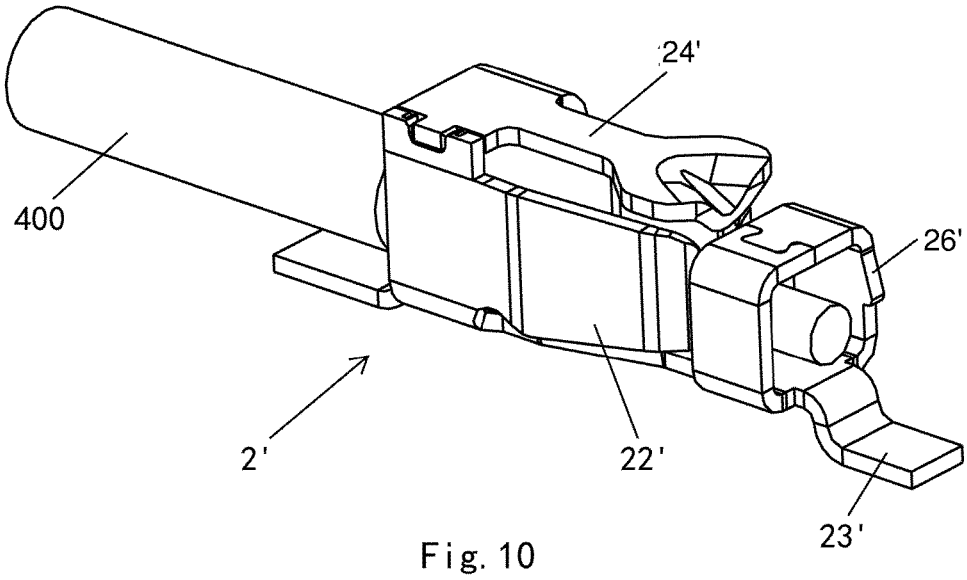
FIG. 10 is a perspective view of the conductive terminal of FIG. 9 with the wire.
Figure 11:
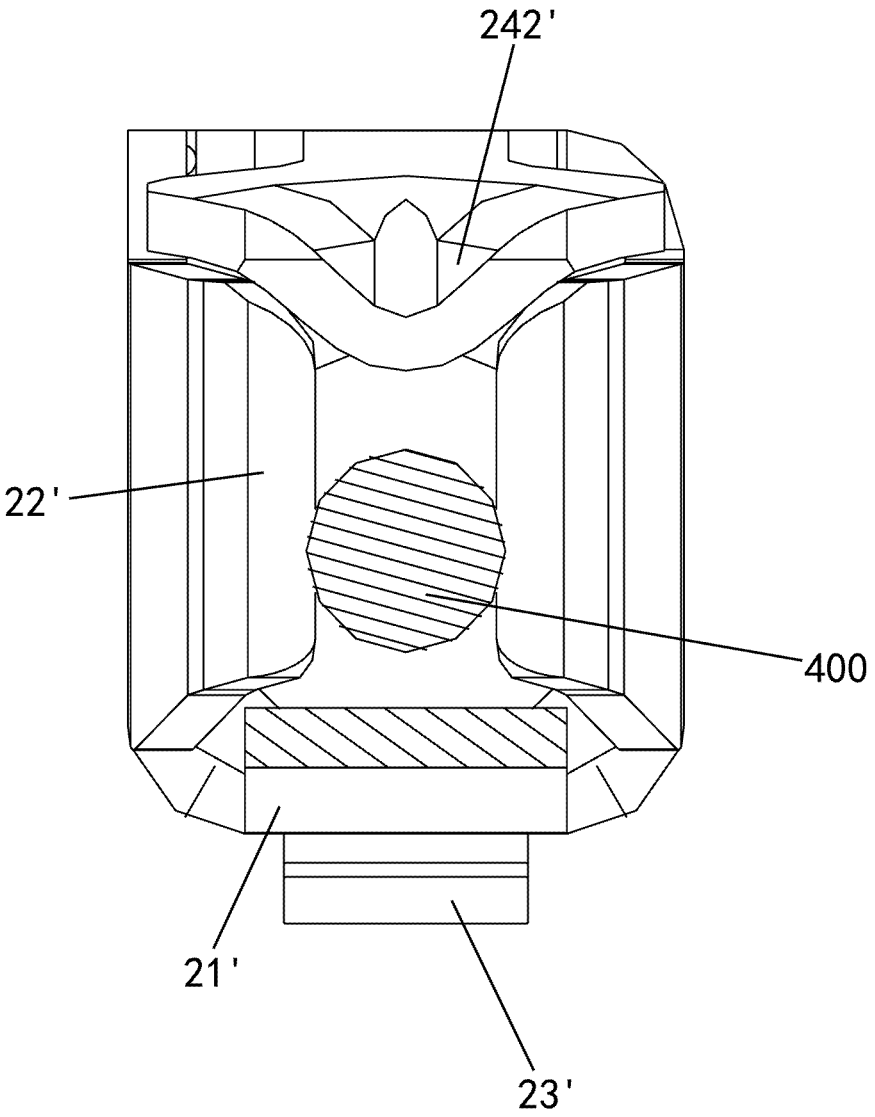
FIG. 11 is a front view of the conductive terminal of FIG. 9 with the wire.

A conductive terminal 2' according to another embodiment of the invention is shown in FIGS. 9-11.

Each conductive terminal 2' has a base 21', a first annular end portion 25' located at a first end of the base 21' and a second annular end portion 26' located at an opposite second end of the base 21'. The first annular end portion 25' has two side walls 251' and a bottom 252'. Each conductive terminal 2' also has a pair of resilient contact arms 22', a releasing mechanism 24', and a pair of solder feet 23'. The releasing mechanism 24' includes a cantilever 241' and a wedged protrusion 242'.

With respect to the conductive terminal 2 of the embodiment shown in FIGS. 1-8, the conductive terminal 2' differs only in that the releasing mechanism 24' is disposed on a side of the conductive terminal 2' opposite the pair of solder feet 23'. A first end of the cantilever 241' is attached to the bottom 252', and the cantilever 241' extends to an opposite second end in a direction toward the second end of the base 21'. The wedged protrusion 242 is disposed at the second end of the cantilever 241. The wedged protrusion 242' is adapted to be inserted between the pair of resilient contact arms 22' to move the pair of resilient contact arms 22' in a direction away from each other.

One of the pair of solder feet 23' extends from a top of the first annular end portion 25' in a direction away from the conductive terminal 2, and the other of the pair of solder feet 23' extends from a top of the second annular end portion 26' in a direction away from the conductive terminal 2. The pair of solder feet 23' are electrically connected to the pair of resilient contact arms 22'.

The conductive terminal 2' is disposed in the housing 1 such that the releasing mechanism 24' faces a bottom of the body 12. At least one second releasing hole (not shown) respectively aligned with the wedged protrusion 242' is provided in the bottom of the body 12. The external releasing tool 500 is adapted to be inserted in the second releasing hole to press the wedged protrusion 242' from below the circuit board 200, separating the pair of resilient contact arms 22' by pressing the wedged protrusion 242' upwardly.

Advantageously, the connector 300 according to the above embodiments is disposed in the opening 201 of the circuit board 200, forming the connector assembly 100 with reduced overall height, which correspondingly reduces the space occupied by the connector assembly 100. The overall height of the connector assembly 100 is further reduced since the wire 400 is inserted into the connector 300 in a manner parallel to the circuit board 200. Thus, the size of electronic equipment comprising such connector assembly 100 is reduced. Furthermore, since the conductive terminal 2, 2' comprises a wire releasing mechanism 24, 24', the wire 400 may be plugged in and pulled out the connector 300 repeatedly, and therefore may be replaced conveniently.

What is claimed is:

1. A connector, comprising:

a housing formed of an insulative material and having a flange mounted on a first surface of a circuit board and a body extending through the circuit board beyond an opposite second surface of the circuit board, the body having an insertion hole;

at least one conductive terminal received in the housing and having a pair of resilient contact arms contacting a wire inserted through the insertion hole, a pair of solder feet soldered to the circuit board and electrically connected to the pair of resilient contact arms, and a releasing mechanism integrally formed with the pair of resilient contact arms and the pair of solder feet, the releasing mechanism adapted to move the pair of resilient contact arms away from each other to release the wire; and a lid detachably mounted on the flange and covering an interior of the housing.

2. The connector of claim 1, wherein the releasing mechanism has a cantilever and a wedged protrusion disposed on an end of the cantilever.

3. The connector of claim 2, wherein the wedged protrusion is inserted between the pair of resilient contact arms to move the pair of resilient contact arms away from each other.

4. The connector of claim 3, wherein the conductive terminal has a first annular end portion disposed on a first end.

5. The connector of claim 4, wherein the first annular end portion is aligned with the insertion hole.

6. The connector of claim 5, wherein the wire is inserted between the pair of resilient contact arms through the first annular end portion.

7. The connector of claim 6, wherein the pair of resilient contact arms extend from two side walls of the first annular end portion toward an opposite second end of the conductive terminal.

8. The connector of claim 7, wherein the cantilever extends from a top of the first annular end portion toward the second end of the conductive terminal.

9. The connector of claim 8, wherein one of the pair of solder feet extends from the top of the first annular end portion in a direction away from the conductive terminal.

10. The connector of claim 9, further comprising an external releasing tool adapted to press the wedged protrusion from above the circuit board to move the wedged protrusion between the pair of resilient contact arms.

11. The connector of claim 10, wherein the lid has at least one first releasing hole aligned with the wedged protrusion, the external releasing tool insertable into the first releasing hole to press the wedged protrusion.

12. The connector of claim 10, wherein the conductive terminal has a second annular end portion disposed on the second end.

13. The connector of claim 12, wherein an end of the wire is disposed within the second annular end portion.

14. The connector of claim 13, wherein the other of the pair of solder feet extends from a top of the second annular end portion in a direction away from the conductive terminal.

15. The connector of claim 7, wherein the cantilever extends from a bottom of the first annular end portion toward the second end of the conductive terminal.

16. The connector of claim 15, wherein one of the pair of solder feet extends from the top of the first annular end portion in a direction away from the conductive terminal.

17. The connector of claim 16, wherein the conductive terminal has a second annular end portion disposed on the second end, and the other of the pair of solder feet extends from a top of the second annular end portion in a direction away from the conductive terminal.

18. The connector of claim 17, wherein a bottom of the body has at least one second releasing hole aligned with the wedged protrusion.

19. The connector of claim 18, further comprising an external releasing tool insertable into the second releasing hole to press the wedged protrusion from below the circuit board and move the wedged protrusion between the pair of resilient contact arms.

20. The connector of claim 1, wherein the wire extends through the insertion hole in a direction parallel to the second surface of the circuit board.

21. The connector of claim 1, wherein the flange has a plurality of mounting holes through which the housing is mounted on the circuit board.

22. The connector of claim 21, wherein the pair of solder feet extend through a plurality of slots in the flange to electrically connect to pads on the first surface of the circuit board.

23. A connector, comprising:

a housing having a flange mounted on a first surface of a circuit board and a body extending through the circuit board beyond an opposite second surface of the circuit board, the flange having a plurality of mounting holes through which the housing is mounted on the circuit board, the body having an insertion hole; and at least one conductive terminal received in the housing and having a pair of resilient contact arms contacting a wire inserted through the insertion hole, a pair of solder feet soldered to the circuit board and electrically connected to the pair of resilient contact arms, and a releasing mechanism adapted to move the pair of resilient contact arms away from each other to release the wire.

24. The connector of claim 23, wherein the pair of solder feet extend through a plurality of slots in the flange to electrically connect to pads on the first surface of the circuit board.

* * * * *